US006385407B1

(12) United States Patent
Inose

(10) Patent No.: US 6,385,407 B1
(45) Date of Patent: May 7, 2002

(54) ACCOMMODATING ENCLOSURE AND MANAGEMENT SYSTEM

(75) Inventor: Fumiyuki Inose, Tokorozawa (JP)

(73) Assignee: Hitachi Maxell, Ltd., Osaka (JP)

( * ) Notice: Subject to any disclaimer, the term of this patent is extended or adjusted under 35 U.S.C. 154(b) by 0 days.

(21) Appl. No.: 09/472,973

(22) Filed: Dec. 28, 1999

(30) Foreign Application Priority Data

Dec. 28, 1998 (JP) ..... 10-373442

(51) Int. Cl.[7] ..... G03G 15/00; H04K 1/00

(52) U.S. Cl. ..... 399/24; 399/12; 399/13; 399/119; 340/539; 222/DIG. 1

(58) Field of Search ..... 347/7, 9, 12, 49, 347/86; 399/8, 12, 13, 24, 25, 77; 222/DIG. 1, 539; 340/551, 540, 572; 380/21, 28, 34

(56) References Cited

U.S. PATENT DOCUMENTS 4,695,954 A * 9/1987 Rose et al. ..... 364/413
5,132,729 A * 7/1992 Matsushita et al. ..... 399/12
5,151,684 A * 9/1992 Johnsen ..... 340/572
5,262,712 A * 11/1993 Klotzig et al. ..... 323/224
5,450,492 A * 9/1995 Hook et al. ..... 380/28
5,493,805 A * 2/1996 Penuela et al. ..... 40/633
5,930,553 A * 7/1999 Hirst et al. ..... 399/8
6,053,597 A * 4/2000 Hirota ..... 347/19

FOREIGN PATENT DOCUMENTS

WO WO-98/43136 * 10/1998

* cited by examiner

*Primary Examiner*—Sophia S. Chen
*Assistant Examiner*—Hoang Ngo
(74) *Attorney, Agent, or Firm*—Birch, Stewart, Kolasch & Birch, LLP

(57) ABSTRACT

The container and the management system include a storage portion to accommodate an expendable product to be used by an apparatus; and a memory to store identification information that can be read out by an external device; wherein the container is removably installed in the apparatus and the apparatus retrieves expendable product identification information and remaining amount information from the container to determine if the expendable product is an appropriate one.

14 Claims, 6 Drawing Sheets

ACCOMMODATING ENCLOSURE AND MANAGEMENT SYSTEM

BACKGROUND OF THE INVENTION

The present invention relates generally to a management system and more specifically to a management system for assuring an appropriate use of expendable products. This invention is suitably applicable, for example, to a system for recycling expendable products. The "expendable products" include mediums and recording materials for use in printers, copying machines, facsimiles, word processors and composite apparatus of these. The mediums include inks, toners and ribbons and the recording materials include plain paper, OHP films and thermal paper.

The expendable products are often accommodated in cartridges, tanks or cases, whatever the containers are called. The recycling system of this invention is not limited to a field of printing and the expendable products widely range from fuel, lubricating oil, coolant and preservative to other compounds. The recycling system of this invention does not necessarily require refilling the expendable products into their containers and the spent containers may be discarded.

A "non-contact information medium" generally refers to a medium which has a combination of an information recording medium, such as IC chip, and a non-contact communication means, such as coil and antenna, for communication between the information recording medium and external devices, and which communicates in a non-contact manner with external devices. Hence, as long as it communicates in a non-contact mode, there are no limitations on the wavelength of radio wave or the communication distance. The non-contact information medium in the broad sense may use any communication means. This patent application, however, assumes that the communication is established via electromagnetic wave.

A typical non-contact information medium incorporating an IC chip is a non-contact IC card that communicates in a non-contact manner with a reader/writer by using, for example, electromagnetic coupling or microwave. In this application, the "IC card" generally includes smart cards, intelligent cards, chip-in-cards, microcircuit (microcomputer) cards, memory cards, super cards, multi-function cards and combination cards.

The non-contact information medium is not limited to these cards in terms of shape and also includes so-called IC tags. Here the "IC tags" have the similar functions to those of the IC cards and include all the information recording mediums of a stamp size or ultra-small size or with a shape of coin. They also include a coil-on-chip type module with a communication coil formed on the IC chip by a micro-fabrication technology.

In electrophotographic recording apparatus, such as ink jet printers and copying machines, the users are often required to use genuine products, such as dedicated inks, toners and paper contained in dedicated cartridges that are specified by the manufacturer (the "genuine products," unless otherwise specifically stated, include those products that can be properly identified as their equivalents).

One of the reasons for the required use of genuine products is that the manufacturer guarantees the performance of the apparatus by verifying beforehand that the desired performance of the apparatus (stable operation and stable output quality) can be assured when the genuine products are used. Another reason is the ease with which the expendable products can be replaced. Where a dedicated container is used, when it is checked and found reusable, the container needs only to be refilled with an expendable product and shipped again, which is advantageous from the standpoint of effective use of resources and contributes to a reduction in cost and environmental effects.

However, some users may use expendable products from other manufacturers which are not genuine and are often inexpensive but with degraded quality (hereinafter referred to as "pirated" product). In more concrete terms, the users may use a pirated container from the beginning or may purchase a genuine product at first and, when the expendable product runs out, fill the genuine container with the pirated expendable product. The pirated expendable product with degraded quality will lead to a failure or malfunction of the apparatus. There are users who even have the manufacturer guarantee the repair of the failed apparatus.

SUMMARY OF THE INVENTION

It is therefore an exemplary, general object of the present invention to provide a new and useful container and a management system that can solve the conventional problems.

More specifically, it is an exemplary object of the present invention to provide inexpensively a management system for a container and an expendable product which forestalls possible deterioration, performance degradation, failures or malfunctions of the apparatus by checking whether the container, preferably both the container and the expendable product, is a genuine product.

It is another exemplary object of the present invention to protect management data of the container and expendable product management system against being altered easily.

To achieve the above objectives, the container in one embodiment of the present invention has a storage portion to accommodate an expendable product used by the apparatus and a memory to store ID information of the container that can be read out by an external device, and is removably installed in the apparatus. With this container, the external device can determine whether or not the container is a genuine product, by reading the ID information stored in the memory.

The management system as an example embodiment of the present invention is a system for supplying the expendable product in a container for use in the apparatus, which system comprises: a memory joined to the container; and a mechanism to write or read information in the memory; wherein when the apparatus decides that the information stored in the memory is abnormal, a necessary step is taken. In the management system, when the apparatus decides that the information stored in the memory is abnormal (e.g., the container is not a genuine product, the expendable product accommodated in the container is not a genuine product, the permitted number/time of use is exceeded, or the container and/or the expendable product is degraded), this management system takes appropriate steps (e.g., stopping the operation of the apparatus, indicating that the information is abnormal, or indicating the steps to be taken).

The management system as another example embodiment of the present invention includes: a container removably installed in an apparatus and accommodating an expendable product to be used by the apparatus; a non-contact information medium positioned on the container; a reader/writer capable of communicating with the non-contact information medium in a non-contact manner; and a processing device connected to the reader/writer and adapted to check an appropriate use of the expendable product according to information obtained from the non-contact information medium by the reader/writer; wherein the non-contact information medium has a memory to store ID information of the container and a communication portion allowing the memory to communicate with the reader/writer in a non-contact manner. With this management system, the processing device can check whether the container is a genuine product by reading the ID information stored in the memory.

The management system as a further example embodiment of the present invention includes: a container removably installed in an apparatus and accommodating an expendable product to be used by the apparatus; a reader/writer; and a processing device connected to the reader/writer and adapted to check an appropriate use of the expendable product according to information obtained by the reader/writer; wherein the container has a storage portion to accommodate the expendable product, a memory to store ID information of the container and a communication portion allowing the memory to communicate with the reader/writer in a non-contact manner. With this management system, the processing device can check whether the container is a genuine product by reading the ID information stored in the memory.

Other objects and further features of the present invention will become apparent from the following description of embodiments taken in conjunction with the accompanying drawings.

DESCRIPTION OF PREFERRED EMBODIMENTS

Figure 1:
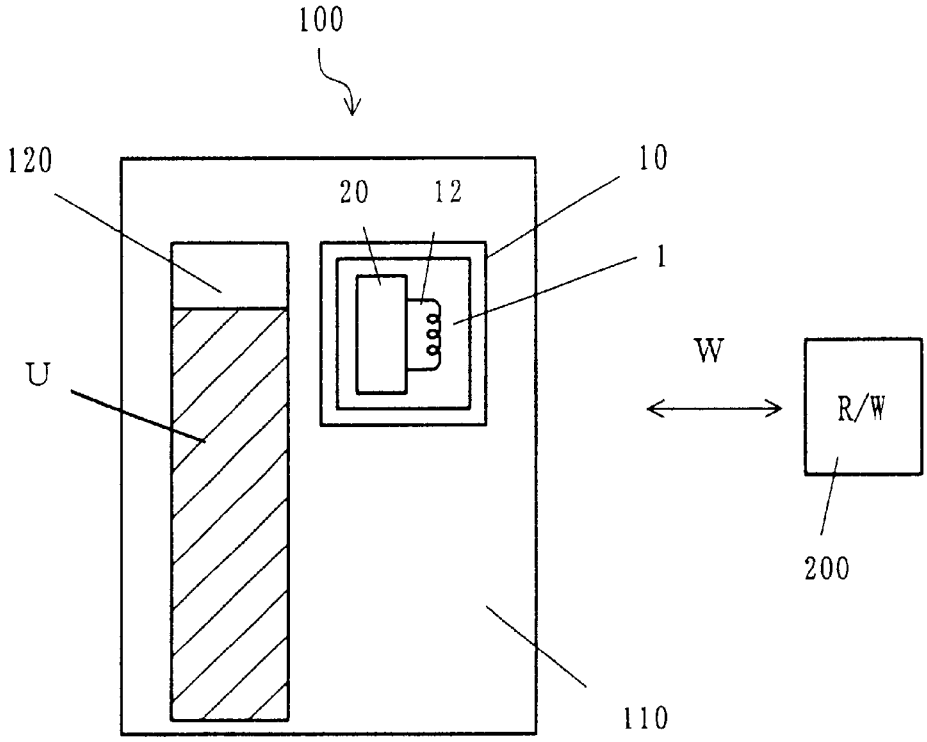
FIG. 1 is a schematic block diagram showing the relation between an ink cartridge as one embodiment of the present invention and a reader/writer as an external device

Now, by referring to the accompanying drawings, an ink cartridge 100 as one embodiment of the container of this invention will be described. Like reference numerals refer to identical members throughout the drawings and their repetitive explanations are omitted.

As shown in FIG. 1, the ink cartridge 100 has a container body 110, a storage portion 120 formed in the container body 110 to accommodate ink U, and a non-contact information medium 1. FIG. 1 is a schematic block diagram showing the relation between the ink cartridge 100 and a reader/writer 200 as an external device. While the reader/writer 200 is incorporated in an apparatus (ink jet printer) 400 of this embodiment, as described later by referring to FIGS. 6 and 7, it may also be provided external to the apparatus 400.

The container body 110 is made of a molded plastic and the storage portion 120 accommodates a desired ink as the expendable product, such as black ink, cyan ink, magenta ink and yellow ink.

The non-contact information medium 1 is accommodated in a resin case (or package) 10. The resin case 10 protects the non-contact information medium 1 against impacts from outside and is watertight to prevent the ink from coming into contact with the non-contact information medium 1. The resin case 10 has a function of physically preventing an unauthorized person from easily taking out the non-contact information medium 1. For example, unless the resin case 10 is opened in an appropriate procedure, the content of a memory 26, described later, in the non-contact information medium 1 is erased.

The non-contact information medium 1 and the resin case 10 may be integrally formed in one piece by molding.

The case 10 is shaped like a card. The case 10, however, may take any desired shape conforming to the shape of the ink cartridge 100 (for example, the shape of a pendant, coin, key, card and tag). It may also be formed convex to fit into a recessed portion of the container body 110.

Alternatively, the case 10 may have various switches, not shown, for display, keyboard and power supply to perform a variety of functions. The case 10 may be formed with an embossed marking, a sign panel, a hologram, a stamp, a hot stamp, an image print or a picture.

The case 10 and the container body 110, rather than being formed as separate members, may be formed integral to have the non-contact information medium 1 mounted on the container body 110.

Because the non-contact information medium 1 communicates in a non-contact manner with the reader/writer 200, which forms a part of the external device, by using electromagnetic wave described later, the non-contact information medium 1 has no terminals or contacts to be connected to the external device. The case 10 is hermetically sealed. As a result, the non-contact information medium 1 has no risk of damaging or contaminating the environment of the storage portion 120 as by the terminals or being damaged or contaminated by the terminals. Further, because the case 10 is water-proofed, it can be washed together with the cartridge during the recycling process described later, making them easy to handle. This invention, however, does not exclude the use of a contact type information medium.

Figure 2:
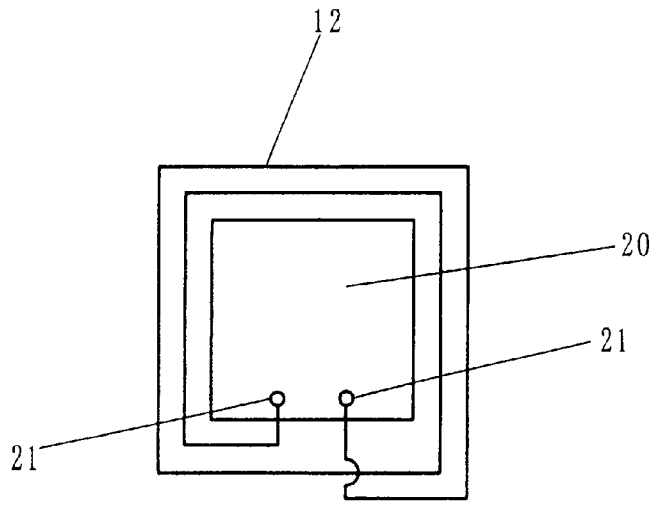
FIG. 2 is a plan view showing an example construction of a non-contact information medium of FIG. 1.
Figure 3:
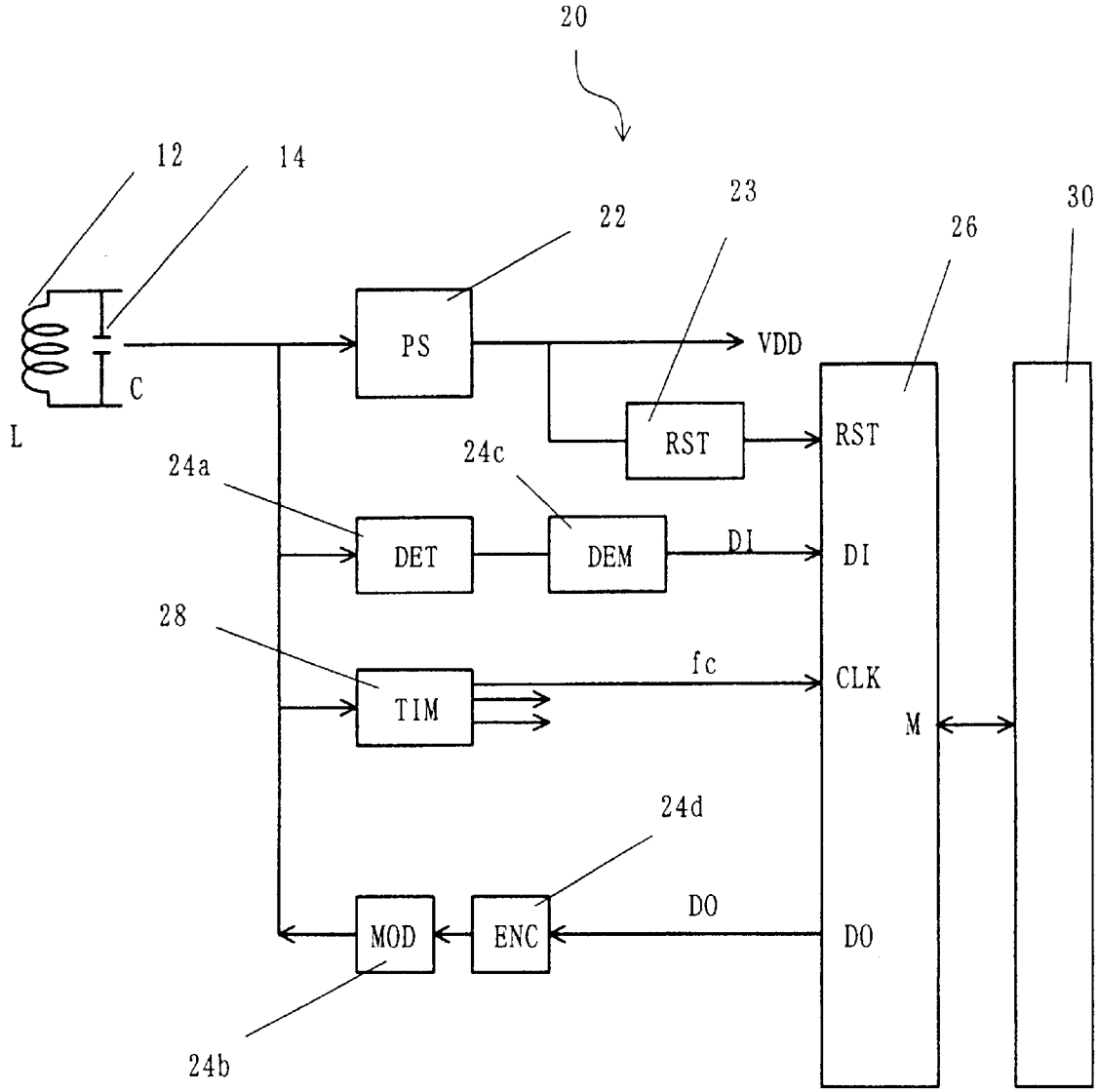
FIG. 3 is a schematic block diagram showing the detail of a non-contact interface of the non-contact information medium of FIG. 1.

By referring to FIGS. 2 and 3, the construction of the non-contact information medium 1 will be described. FIG. 2 is a schematic plan view showing an example construction of the non-contact information medium 1 of FIG. 1. FIG. 3 is a schematic block diagram showing the detail of an IC chip 20 of the non-contact information medium 1 shown in FIG. 1.

An antenna coil 12 is electromagnetically coupled with a coil of the reader/writer 200 in a non-contact manner and communicates with the reader/writer 200 via electromagnetic wave W having a carrier frequency $f_c$ (for example 13.56 MHz) in a desired frequency band. The antenna coil 12 may use a subcarrier frequency as required. FIG. 1 conceptually shows the antenna coil 12, which in the actual non-contact information medium 1 is formed to enclose the IC chip 20, as shown in FIG. 2. The antenna coil 12 may be formed in any desired shape when viewed from above, such as circular, rectangular or oval shape. The antenna coil 12 is electrically connected, as by wire bonding or TAB (tape automated bonding), to connection terminals 21 of the IC chip 20. The communication distance between the antenna coil 12 and the reader/writer 200 may be several centimeters to several tens of centimeters, for example. The antenna coil 12 can also be made by methods not commonly known in the art, such as etching, printing based on printed wiring method, and forming by wiring, all using copper and aluminum. The antenna coil 12 has a desired dimension, shape, self-inductance, and mutual inductance according to the mounting area and other conditions. This invention does not exclude the use of antennas known in the trade in place of the antenna coil 12, such as dipole antenna, monopole antenna, loop antenna, slot antenna and microstrip antenna.

The antenna coil 12 may be a coil-on-chip type antenna formed on the IC chip 20 by the micro-fabrication technology to reduce the cost and size.

Referring to FIG. 3, the antenna coil 12 is preferably connected with a resonance capacitor 14. The resonance capacitor 14 has an electrostatic capacitance C and cooperates with an inductance L of the antenna coil 12 to form a resonance circuit that resonates at a carrier frequency $f_c$ of the transmitting and receiving electromagnetic wave. A resonance frequency $f_r$ generated by the antenna coil 12 and the resonance capacitor 14 is $f_r=(1/2\pi)(LC)^{-1/2}$. Making the resonance frequency $f_r$ coincide with the carrier frequency $f_c$ can cause a large resonance current to flow through the antenna coil 12 and the resonance capacitor 14. The resonance current can be supplied to the IC chip 20.

The resonance capacitor 14 may be formed on the same plane (i.e., in a single layer structure) as the components of the IC chip 20, as described later, or above the IC chip components (i.e., in a multilayes structure).

As shown in FIGS. 1 and 3, the IC chip 20 has a power supply circuit 22, a reset signal generation circuit 23, a transmission/reception circuit 24, a logic control circuit 26, a timing circuit (TIM) 28 and a memory 30, and communicates with the reader/writer 200 to read and write the memory 30.

The power supply circuit (PS) 22 is connected to the a reset signal generation circuit 23 which is connected to a reset terminal (RST) of the logic control circuit 26. The IC chip 20 produces by electromagnetic induction an operation voltage Vcc (for example 5 V) for communication system from the radio wave W (carrier frequency $f_c$) received from the reader/writer 200 and supplies the operation voltage to logic circuits. When the operation voltage Vcc is generated, the reset signal generation circuit 23 resets the logic control circuit 26 to make it ready for a new operation.

The transmission/reception circuit 24 includes a detector (DET) 24*a*, a modulator (MOD) 24*b*, a demodulator (DEM) 24*c*, and an encoder (ENC) 24*d*. The demodulator 24*c* and the encoder 24*d* are connected to data terminals DI and DO, respectively, of the logic control circuit 26. A decoder formed by a D/A converter may be arranged behind the demodulator 24*c* as an independent member, if necessary. A timing circuit 28 is used to generate various timing signals and connected to a clock terminal (CLK) of the logic control circuit 26.

The receiving part of the transmission/reception circuit 24 has the detector 24*a* and the demodulator 24*c*. The received radio wave W is detected by the detector 24*a*, and the demodulator 24*c* recovers a base band signal to obtain data from the detected signal. The recovered base band signal (or a signal decoded thereafter, as required) is sent as data signal DI to the logic control circuit 26.

The transmitting part of the transmission/reception circuit 24 has the modulator 24*b* and the encoder 24*d*. The modulator 24*b* and the encoder 24*d* can use any configuration known in the art. The transmitting part modulates the carrier wave according to the transmission data and sends it to the antenna coil 12 for transmission. Among the modulation systems that can be used are, for example, an ASK that changes the amplitude of the carrier frequency and a PSK that changes the phase. A load modulation may also be used. The load modulation is a method that modulates a medium power (load) according to the transmission signal. The encoder 24*d* encodes (bit-encodes) the data DO to be transmitted with a predetermined code (e.g., Manchester encoding and PSK encoding) and send the encoded data to the antenna coil 12.

The transmission/reception circuit 24 is controlled by the logic control circuit 26 and operates in synchronism with a timing signal (clock) generated by the timing circuit 28. The logic control circuit 26 can be realized by a CPU.

The memory 30 has ROM, RAM, EEPROM and/or FRAM to store various data. When the memory 30 is formed as a nonvolatile memory, it permits the data stored to be read out by the reader/writer 200 but does not allow it to be changed. The memory 30 may also be formed as a rewritable memory and the logic control circuit 26 may control access to the memory from the reader/writer 200 by software. Based on the data stored in the memory, the non-contact information medium 1 can communicate with the reader/writer 200 and the logic control circuit 26 can perform predetermined processing.

The memory 30 can store one or more of the following information items: ID number of the ink cartridge 100 (manufacturer ID, responsible department, address, telephone number, facsimile number, e-mail address, product lot number, date of manufacture, etc.); information on the conditions of use of the ink in the printer (tentative operation time (e.g., 3000- or 6000-sheet printing), period valid for use (e.g., within 3 years after ink filling), service temperature, list of printers on which the ink can be used, countermeasures to be taken in the event of failure); ID information of ink manufacturer (manufacturer ID, responsible department, address, telephone number, facsimile number, e-mail address and date of manufacture), information on ink inspection and recycle history (date and time and inspector of final inspection, his contact address, date and time of ink refilling, a person who did the refilling, his contact address, etc.); information on the amount of ink remaining in the ink cartridge 100; the number of times and hours that the cartridge was permitted to be used; information on ink composition; and information on actual time of use of the cartridge.

By storing, in the memory 30, a variety of data necessary for the management system described later, the reliability of the data in this invention is higher than when these data are manually recorded. The information stored in the memory 30 may be protected by cryptograph.

Figure 4:
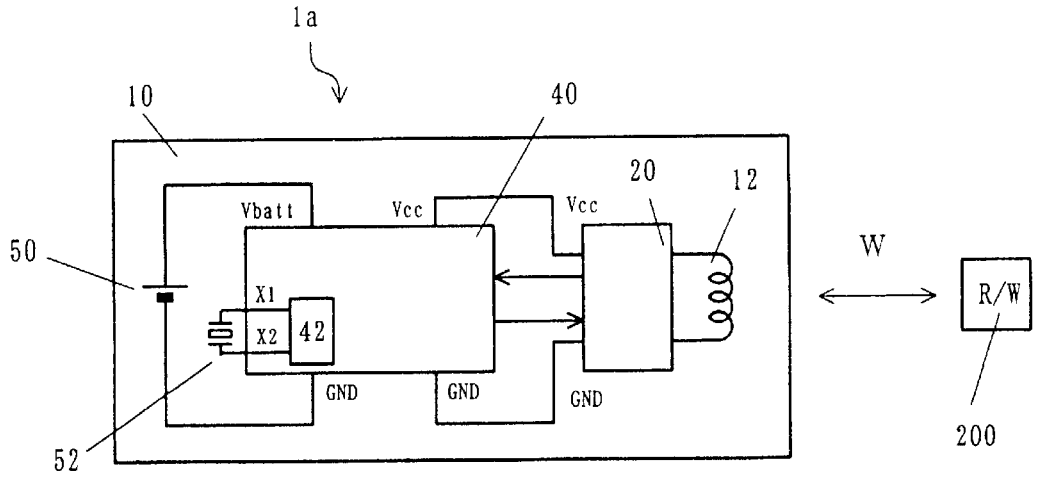
FIG. 4 is a schematic block diagram showing a variation of the non-contact information medium of FIG. 1.

The information on the actual time of use may be obtained from the reader/writer 200 or a terminal device 300 described later, or the non-contact information medium 1 may have an actual time clock. Such a non-contact information medium 1*a* is shown in FIG. 4. The non-contact information medium 1*a* has an IC unit 40, an actual time clock 42 provided in the IC unit, and a battery 50 and a quartz oscillator 52 both connected to the IC unit 40. The IC unit 40 is connected to a non-contact interface 20 and performs a non-contact communication through a coil 12 connected to the non-contact interface 20. The actual time clock 42 is connected to the quartz oscillator 52 (oscillation frequency: 32,768 kHz) to measure the actual time. The actual time is sent to the logic control circuit 26, from which it is transferred to the memory 30. The actual time clock 42 may be temperature-compensated, if necessary.

The IC unit 40 may have a sensor, as required, that measures environmental parameters of the expendable product (selected from temperature, humidity, pressure, amount of light, amount of noise, speed, vibration, impacts and the like) and outputs the measurements. Such a sensor includes a temperature sensor, a humidity sensor or a pressure sensor. The sensor can be any sensor known in the art. When a temperature sensor is used, for example, it is formed integral with other circuits in the IC by using a band gap circuit. While a sensor for detecting the amount of ink remaining in the storage portion 120 of the ink cartridge 100 is normally arranged on the printer, this sensor may be provided in the IC unit 40. When these sensors are used, the IC unit 40 will have an A/D converter for converting the outputs of the sensors into digital signals and other associated circuits. The logic control circuit 26 can check the environment of the expendable product and the storage time to determine whether the expendable product has deteriorated or not.

The constitutional elements of the non-contact information medium 1 and 1*a* may be formed as separate IC chips or as a one-chip monolithic semiconductor device. If the one-chip IC has a coil formed on the IC chip by the micro-fabrication technology, there is no need for leadout wires to be formed on the outside of the IC chip, making the construction very simple. This in turn reduces the circuit and assembly cost and greatly improves the reliability of the circuit. This offers another advantage of eliminating a risk of the connecting terminals being broken by the bending of the case 10.

Figure 5:
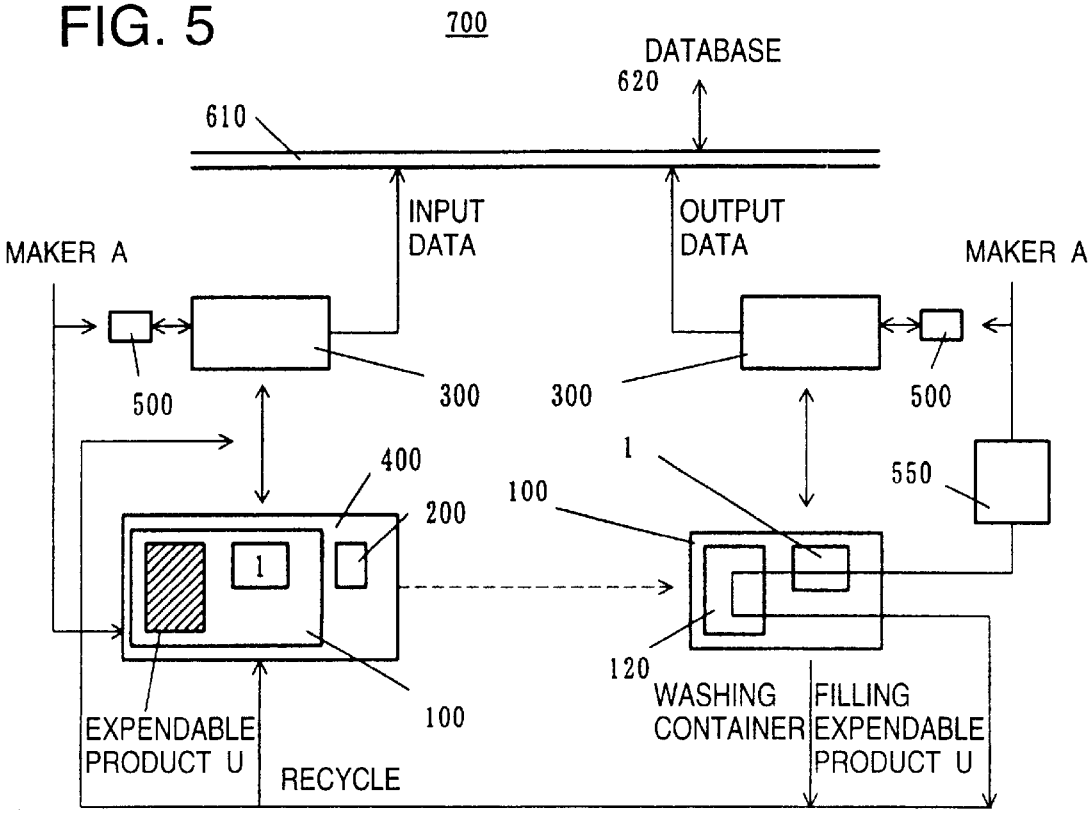
FIG. 5 is a schematic block diagram of a management system as one embodiment of the present invention.

Next, a management system 700 as one embodiment of this invention will be described by referring to FIG. 5. FIG. 5 is a schematic block diagram of the management system 700. The management system 700 is designed to ensure an appropriate use of an expendable product U, an object of management, by storing and managing ID and other information of the container 100 accommodating the expendable product U. In more detail, it is an exemplary object of the management system 700 of this invention to check whether or not the expendable product U used in the apparatus (e.g., printer) is a genuine product and to exclude the ungenuine product during the recycling process (e.g., during the use of the expendable product U by the user and during the replacement of the expendable product U by the manufacturer). Because various data indicating that the expendable product U is genuine are stored in the memory 30, the reliability of the data is improved, compared with a case where these data are recorded manually.

The management system 700 can check whether the container 100 (and preferably the expendable product U) is a genuine product during each recycling process and, when a pirated product is detected, exclude its use, thereby preventing a possible failure of the apparatus. Further, the management system 700 is constructed to make alteration of data difficult, improving the reliability of the data. The management system 700 can also limit access to data and thereby maintain the security of the data easily.

As shown in FIG. 5, the management system 700 has a non-contact information medium 1, a container 100, a reader/writer 200, terminal devices 300A, 300B, an apparatus 400 (ink jet printer in this example), IC cards 500A, 500B, an expendable product refilling device 550, a host interface 610, and a host database 620. The reader/writer 200 is incorporated in the apparatus 400.

The terminal device 300 includes a personal computer that is connected to the apparatus 400 via a printer cable. The terminal device 300 may have the reader/ writer 200. If the terminal device 300 has the reader/writer 200, the manufacturer A can determine whether the container 100 is a genuine product by using the reader/writer 200, without the apparatus 400. In that case, the reader/writer 200 may be integrally installed in the terminal device 300 or connected to a PCI bus of the terminal device through a predetermined interface. Alternatively, the reader/writer 200 and the terminal device 300 may be connected via general communication means such as PHS and IrDA and other connection means.

Figure 6:
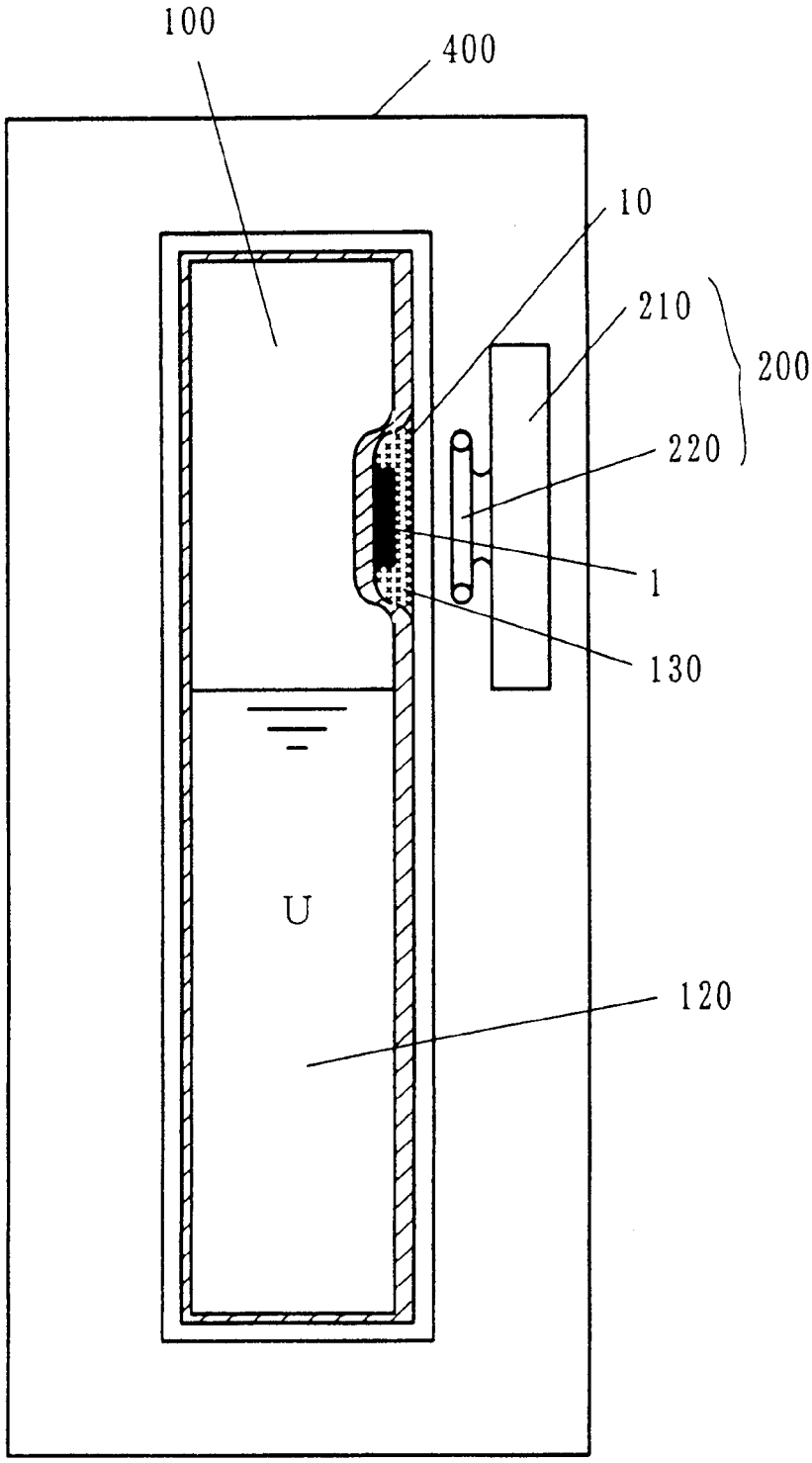
FIG. 6 is a schematic cross section of an apparatus of FIG. 5.
Figure 7:
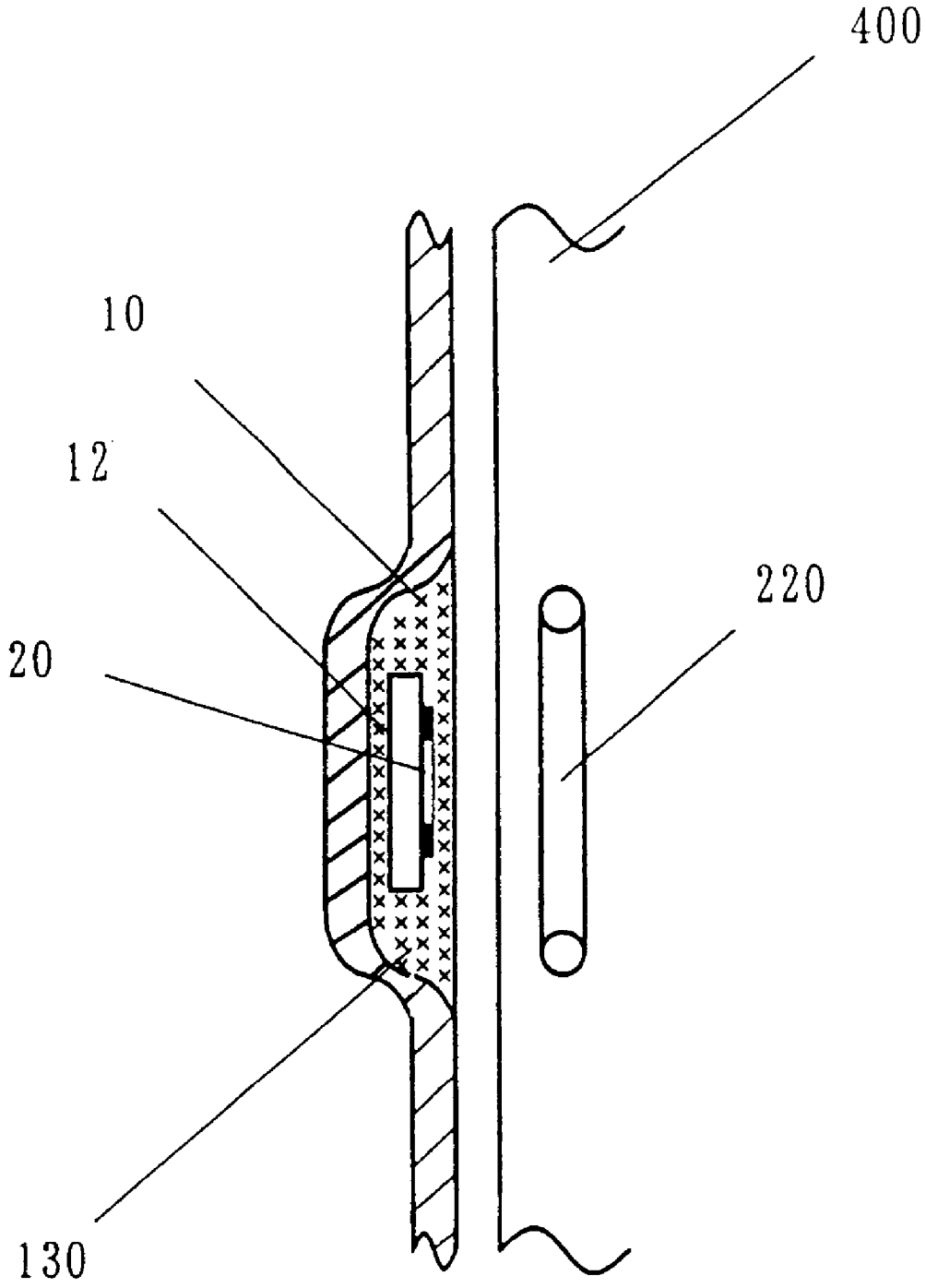
FIG. 7 is a partially enlarged cross section of the apparatus of FIG. 6.

The reader/writer 200 communicates with the non-contact information medium 1 in a non-contact manner to read information from the memory 30 and send it to controllers, not shown, of the terminal device 300 and/or the apparatus 400. The reader/writer 200 is also used to receive information entered into the terminal device 300 and/or apparatus 400 from the IC card 500 or other input means and to write the received information into the memory 30. In this embodiment, the non-contact information medium 1 is unremovably secured to the container 100 (as by embedding). It is also possible to removably fix the non-contact information medium 1 to the container 100. Similarly, in this embodiment, while the reader/writer 200 is unremovably fixed to the apparatus 400 (as by embedding), it may also be removably secured to the apparatus 400. The non-contact information medium 1 and the reader/writer 200 arranged on the apparatus 400 are shown in FIGS. 6 and 7. As a further alternative, the IC card 500 may be formed as a non-contact IC card so that the communication between the non-contact information medium 1 and the reader/writer 200 can be made via the IC card 500.

Referring to FIGS. 6 and 7, the non-contact information medium 1 is sealed in the resin case 10 and is installed in a recess 130 formed in a sidewall of the ink cartridge 100. In this embodiment, the IC chip 20 has a size of about 2 mm square, for example. For security reasons, the non-contact information medium 1 is preferably colored so that it is not recognized from its appearance.

The apparatus 400 can detect the container 100 when it is loaded by a detection means such as a sensor not shown. In response to the result of detection by the detection means, (the controller, not shown, of) the apparatus 400 drives the reader/writer 200. As a result, the reader/writer 200 starts communicating with the non-contact information medium 1 by transmitting radio waves to the non-contact information medium 1.

The apparatus 400 has another detection means for detecting the amount of ink U remaining in the storage portion 120 of the cartridge 100. This detection means can adopt any known construction in the art and its detailed explanation is omitted here. The detection means may, for example, detect the remaining amount of ink by measuring the position of a buoy in the ink moving up or down with the amount of ink, or may indirectly detect the amount of ink from the initially filled amount of ink and the printing time.

Figure 8:
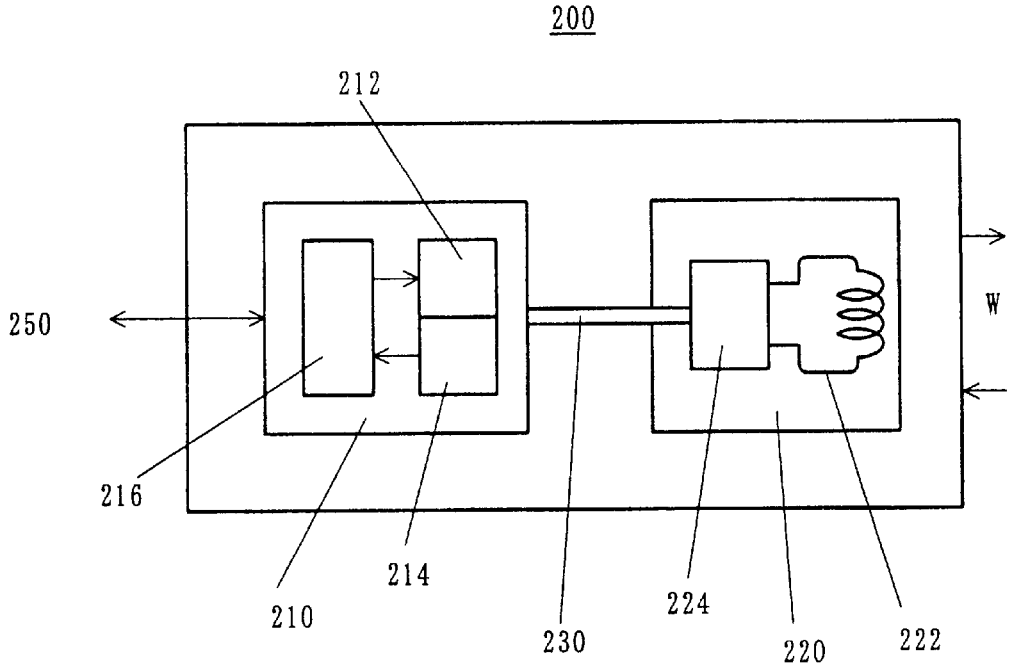
FIG. 8 is a block diagram showing the construction of the reader/writer of FIG. 5.

The reader/writer 200, as shown in FIG. 8, has a control interface unit 210 and an antenna unit 220 interconnected with each other via a cable 230. FIG. 8 is a block diagram showing the construction of the reader/writer 200.

The reader/writer 200 transmits or receives the radio wave W with a predetermined carrier frequency $f_c$ to and from the non-contact information medium 1 and communicates with it by the radio communication. The radio wave W, as described above, can use the carrier frequency $f_c$ of any frequency band (for example, 13.56 MHz). A subcarrier frequency may also be used together, if necessary. The reader/writer 200 is connected to the controller, not shown, of the apparatus 400 via the control interface unit 210 and to the terminal device 300 through a printer cable not shown. Between the control interface unit 210 and the terminal device 300, there may be provided a host, a controller, a personal computer, a display and other external devices.

Figure 9:
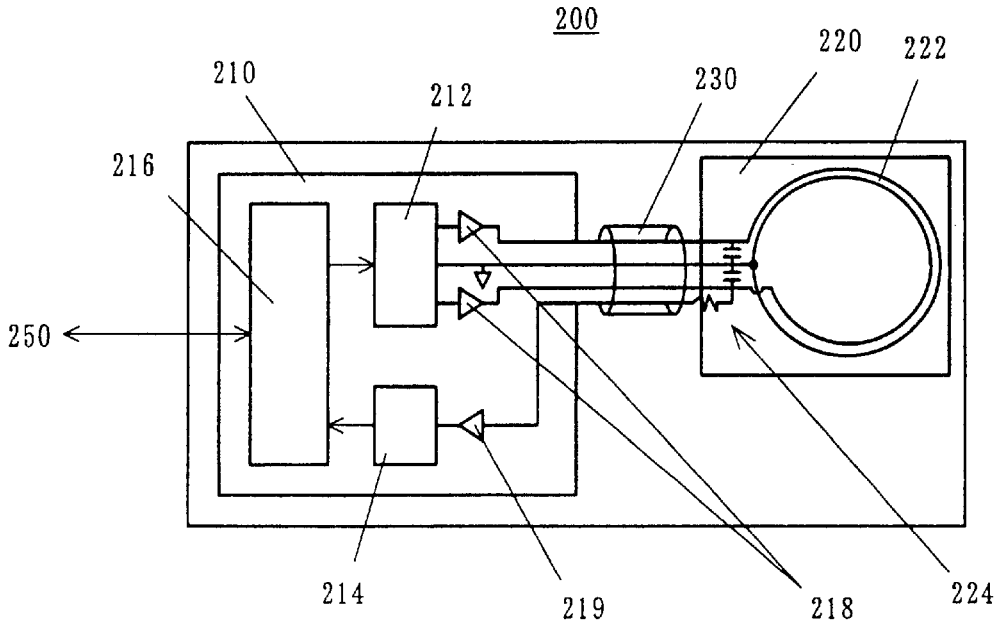
FIG. 9 is a detailed block diagram showing the construction of the reader/writer of FIG. 8.

The control interface unit 210 incorporates a transmission circuit (modulation circuit) 212, a reception circuit (demodulation circuit) 214, and a controller 216. The transmission circuit 212 converts the data received from the apparatus 250 into a transmission signal by, for example, changing the amplitude of the carrier frequency (ASK modulation) and sends the modulated signal to the antenna unit 220. The reception circuit 214 converts a signal received from the non-contact information medium 1 through the antenna unit 220 into a base band signal to obtain data and send it to the apparatus 250. The transmission circuit 212 and the reception circuit 214 are, in the actual circuits, connected to a plurality of drive circuits 218 and 219, as shown in FIG. 9 and are driven by these drive circuits. FIG. 9 is a schematic perspective plan view of the reader/writer 200. A person skilled in the art can easily understand and realize the operation and configuration of the transmission circuit 212, the reception circuit 214 and the drive circuits 218, 219, and therefore their detailed explanations are omitted here.

The antenna unit 220 has an antenna coil 222 and a matching circuit 224, as shown in FIG. 9. FIG. 9 shows an example configuration in which the matching circuit 224 comprises a resistor and a capacitor.

The terminal device 300 is connected to the host interface 610 through an interface (not shown) and can communicate with the host database 620 of a host computer connected to the host interface 610. The terminal device 300 can be connected to the host computer through LAN, Internet and commercially leased circuits. The terminal device 300 is generally owned by both a manufacturer A and a user.

The IC card 500 stores information by which the manufacturer A can access the memory 30 of the non-contact information medium 1 to write the initial condition and the recycle condition into the non-contact information medium 1. The IC card 500 may be of a contact type, a non-contact type or a combination type. The combination type refers to an IC card with two types of function: the contact type and the non-contact type. Hence, when a non-contact type of IC card 500 is used, if the terminal device 300 has the reader/writer 200, it can use the reader/writer 200 for communication with both the non-contact information medium 1 and the IC card 500. When a contact type IC card 500 is used, the terminal device 300 will have a separate contact type reader/writer. The management system 700 also allows the manufacturer A to use an input means such as keyboard or mouse not shown, instead of the IC card 500, and to directly input predetermined information. Instead of the IC card 500, an IC tag may be used.

In this embodiment, the manufacturer A refers to a corporation that loads the expendable product U in the storage portion 120 of the container 100, supplies the loaded container to a user (or retailer), collects the container 100 with the used expendable product U, and refills the expendable product U before supplying the loaded containers to the user (or retailer) again. The manufacturer A may refill the expendable product U into the container 100 collected from the user and then return it to the same user, or place it on a product marketing route not related to the original user. The manufacturer A may be a maker of the apparatus 400 or other makers. The administrator of the management system 700 may be the manufacturer A or other manufacturers.

The IC card 500 includes manufacturer ID information (name of company, address, telephone number, facsimile number, system name, name of person in charge, in-house ID number, etc.). The manufacturer A makes connection to the host interface 610 and the host database 620 and requests the host database 620 to authenticate the ID information. When the ID information of the manufacturer A is authenticated by the host database 620, the manufacturer A is authorized to access the memory 30 of the non-contact information medium 1 and perform initial setting, updating or clearing of the memory 30. The authentication can use any known method in the art and its detailed explanation is omitted here. Then, the manufacturer A stores all or a part of predetermined information into the memory 30 by using the terminal device 300 and the reader/writer 200. These information, as described above, includes one or more of the following information items: ID number of the cartridge 100 (ID information of manufacturer A, product lot number, date of manufacture, etc.); and information on the conditions of use of the ink in the printer (tentative operation time (e.g., 3000- or 6000-sheet printing), period valid for use (date and time of ink filling and service life, etc.), service temperature, list of printers on which the ink can be used, countermeasures to be taken in the event of failure, etc.), ID information of ink maker, information on ink inspection and recycle history, information on the amount of ink remaining in the cartridge 100, information on ink composition, and actual time. Alternatively, the terminal device 300 may retrieve all or a part of these information through the host interface 610 and the host database 620.

The information which the manufacturer A stores in the memory 30 of the non-contact information medium 1 through the terminal device 300 by using the IC card 500 or other means, is also stored in the host database 620. Hence, after this, if the user rewrites the content of the memory 30 of the non-contact information medium 1, the alteration can be detected from the mismatch between the content of the memory 30 and the information stored in the host database 620. Therefore, it is preferably made a prerequisite condition that any person who wishes to access the non-contact information medium 1 must first access the host database 620 and be authenticated by it.

If the access to the host database 620 requires a predetermined ID and authentication and if the communication between the terminal device 300 and the host database 620 uses cryptograph, the security of the information stored in the host database 620 can be maintained. Further, as described above, the resin case 10 is inseparably secured to the ink cartridge 100 in this embodiment and any attempt to forcibly remove the resin case 10 will cause damage to the non-contact information medium 1 or leave scores that can be identified later by the manufacturer A of FIG. 5. The hermetically enclosed non-contact information medium 1 may, for example, be attached with a seal so that any attempt to access the memory 30 in the non-contact information medium 1 will result in the seal being broken, enabling the illicit alteration to be detected. As a result, this also enhances the security of the data stored in the memory 30. Further, a biometric identification device like a fingerprint detector, a speech recognition device and a retinal scanner may be used along with the terminal device 300 for further enhancement of the security of the data, as required.

Alternatively, the container 100 may have a function of the non-contact information medium 1. In that case, the container body 110 is provided with components shown in FIGS. 2 and 3.

The reader/writer 200 communicates with the non-contact information medium 1 or with the container 100 that has the function of the non-contact information medium 1, and thereby transmits the ID information of the container 100 to the controllers, not shown, of the apparatus 400 and/or the terminal device 300. When these controllers authenticate the ID information of the container 100, the apparatus 400 can use the ink cartridge 100 until the ink runs out. The controller may use firmware or software stored in a ROM, not shown, of the apparatus 400, or a printer driver of the terminal device 300.

As to whether the container 100 is a genuine product or not, the controller can determine the genuineness of the container 100 by comparing the ID information of the container 100 of interest with the list of valid containers 100 stored beforehand in the memory, not shown, of the apparatus 400 or terminal device 300 and checking their agreement. When the ID information of the container 100 can not be obtained or when the container 100 has an ID that is not found in the list of the valid containers 100 (e.g., when the container is a pirated product or when the container is used in an apparatus 400 other than the one in which it is supposed to be used), the controller decides that the container 100 is not used properly.

When the controller decides that the container 100 is not used properly, it controls various parts of the apparatus, such as an annunciator portion, not shown, of the apparatus 400, a display connected to the terminal device 300, or alarming means like a speaker or lamp connected to these, to issue an alarm indication or sound. At the same time, the controller should preferably make the apparatus 400 inoperable. As a result, it is possible to prevent a failure or malfunction of the apparatus 400 which would result from the use of an expendable product accommodated in a container 100 that is not supposed to be used in the apparatus.

It is preferred that the controller, even after verifying that the container 100 is genuine, checks whether the expendable product accommodated in the container is a genuine product. The inspection method includes several methods. For example, the controller can make such decision by comparing the present remaining amount of ink currently used in the apparatus 400 with the previous remaining amount of ink recorded in the memory 30. If the present ink amount is smaller than the previous ink amount, the controller decides that the currently used expendable product is a genuine product and allows the content of the memory 30 to be updated with the present ink amount. On the other hand, if the present ink amount is larger than the previous ink amount, the controller decides that the user has illicitly filled ink and that the current expendable product is not properly used, prohibiting the content of the memory 30 from being updated with the present ink amount. In that case, the controller can display the illicit use or other warning, as described above.

More preferably, the controller checks for degradation of genuine expendable products. This is because ink that has not been used for a significantly long period of time after the date of manufacture may solidify and have adverse effects on the apparatus 400 causing a failure or malfunction. In that case, the controller can make the decision by checking the period valid for use, which is stored in the memory 30, and comparing it with the present time obtained from the actual time clock. Such a check is effective when high quality is required of expendable products (for example, fluorescent ink which for a security reason forms a bar code that is normally invisible to naked eye but becomes recognizable only when applied with ultraviolet rays).

The used container 100 is collected and the manufacturer A washes the container 100 and fills the expendable product U into the storage portion 120 by using a refilling device. Then, the manufacturer A uses the IC card 500 to access the host database 620 for authorization and clears the old record in the memory 30 of the non-contact information medium 1 of the refilled container 100 and writes a new record (refilling date, etc.) in it.

When the container 100 and/or the expendable product U in the container are faulty, the manufacturer A collects the container 100. The manufacturer A similarly communicates with the non-contact information medium 1 by using the reader/writer 200 and the terminal device 300. If the memory 30 stores an inspection history, it will help the manufacturer A identify the cause of a failure and improve the expendable product U and/or the container 100.

The operation of the management system 700 will be explained. First, the manufacturer A fills the expendable product. Then, using the IC card 500 and the terminal device 300, the manufacturer A is authenticated by the host database 620 and then writes ID of the container 100 and other necessary information into the memory 30 of the non-contact information medium 1 of the container 100 by using the terminal device 300 and the reader/writer 200. These information is also recorded in the host database 620.

The user who purchased the container 100 installs it in the apparatus 400. The apparatus 400 then detects the container 100 and drives the reader/writer 200. The reader/writer 200 communicates with the non-contact information medium 1 and transmits the data in the memory to the apparatus 400 and/or the terminal device 300 connected to the apparatus 400. In response to this, the controller of the apparatus 400 or the terminal device 300 checks whether the container 100 (and the expendable product U) is genuine or not. When it decides that the product is genuine, the controller permits the use of the container 100 in the apparatus 400. When it decides that the container 100 (and/or expendable product U) is not genuine, the controller stops the operation of the apparatus 400 and indicates warning and necessary information.

When the expendable product runs out, the user calls on the manufacturer A to collect the container 100 or refill the expendable product. The manufacturer A collects the container 100, washes it and then reads the non-contact information medium 1 by the reader/writer 200 connected to the terminal device 300. Because the non-contact information medium 1 is hermetically sealed and waterproofed, it can be washed together with the container 100. The expendable product corresponding to the container 100 whose data was read in is filled into the container by the refilling device 550. For example, a black ink is filled into a monochrome color ink container 100. The manufacturer discards containers 100 with inappropriate ID or damaged containers 100. The manufacturer A, after refilling the container 100, accesses the host database 620 in the similar procedure. Upon being authenticated by the host database 620, the manufacturer A clears the memory 30 of the non-contact information medium 1 and writes new information into it. This prevents the memory 30 from being cleared by an unauthorized person. This information is also recorded in the host database 620. Then, the manufacturer A puts the container 100 in the recycled product distribution route.

Preferred embodiments of the present invention have been described. The present invention is not limited to these embodiments and various changes and modifications may be made within the scope of the invention. For example, the authentication of a person who initially sets or clears the memory 30 may be carried out by the logic control circuit 26 rather than the host database 620. Further, as described above, the apparatus of this invention is not limited to the ink jet printer and the management system of this invention can be applied to a system in general that supplies to the apparatus expendable products in the form of containers. Such a system includes a copying machine that is supplied with toner in the form of cartridge, a camera supplied with sensitized paper in the form of cartridge, and mechanical equipment supplied with working oil in the form of cartridge.

With the non-contact information medium and the container according to one embodiment of the invention, it is possible to prevent ungenuine containers from being used in the apparatus and therefore the apparatus can exhibit the expected performance without any trouble.

What is claimed is:

1. A container removably installed in an apparatus, said container comprising:

a storage portion to accommodate an expendable product used by the apparatus;

a memory to store ID information that can be read out by an external device; and a communication portion that allows the memory to communicate with the external device in a non-contact manner, wherein the memory and the communication portion are formed in a single-chip monolithic semiconductor device, said single-chip monolithic semiconductor device having a micro-fabricated coil formed thereon.

2. A container according to claim 1, wherein the memory further stores at least one of information on the condition of use of the expendable product in the apparatus, ID information of a manufacturer of the expendable product and information on inspection history of the expendable product.

3. A container according to claim 1, further including an actual time clock that measures the actual time.

4. A container according to claim 1, wherein the memory has an alteration prevention function.

5. A container according to claim 1, including:

an authentication means to authenticate access information entered from the external device; and an access control means to allow the memory to communicate with the external device when the authentication means authenticate the access information.

6. A management system comprising:

a container removably installed in an apparatus and accommodating an expendable product to be used by the apparatus;

a reader/writer;

a processing device connected to the reader/writer and adapted to check an appropriate use of the expendable product according to information obtained by the reader/writer;

wherein the container has a storage portion to accommodate the expendable product, an IC chip having a memory to store ID information of the container and a communication portion allowing the IC chip to communicate with the reader/writer in a non-contact manner; and a detection portion to detect the amount of the expendable product remaining in the container;

wherein the memory further stores a detected value of the detection portion; and wherein when the remaining amount of the expendable product detected by the detection portion is smaller than the previous remaining amount of the expendable product stored in the memory, the processing device allows the memory to be updated with the present remaining amount of the expendable product and, when the remaining amount of the expendable product is larger than the previous remaining amount of the expendable product stored in the memory, prohibits the memory from being updated with the present remaining amount of the expendable product and stops the operation of the apparatus.

7. A management system according to claim 6, wherein the memory further stores at least one of information on the condition of use of the expendable product in the apparatus, ID information of a manufacturer of the expendable product and information on inspection history of the expendable product.

8. A management system according to claim 6, wherein the IC chip further includes a controller that enables a clear signal to clear the memory after an appropriate authentication process.

9. A management system according to claim 6, wherein the processing device further includes a decision means to check by using the memory whether or not the expendable product is appropriately used and an warning means to annunciate when the decision means decides that the expendable product is used inappropriately.

10. A management system according to claim 9, wherein the decision means decides that the container and/or the expendable product are not appropriate when they are not supposed to be used in the apparatus.

11. A management system according to claim 6, wherein the processing device is connected to the apparatus and, when it is decided that the expendable product is not used appropriately, stops the operation of the apparatus.

12. A management system according to claim 6, wherein the management system is a recycling system for the expendable product and further includes a filling device to fill the expendable product into the container.

13. A management system according to claim 12, wherein the apparatus is a printing apparatus and the container is an ink cartridge or a toner cartridge.

14. The management system according to claim 6, wherein said reader/writer includes an antenna unit and a control interface unit.

* * * * *